US005126794A

United States Patent [19]

Altmann

[11] Patent Number: 5,126,794

[45] Date of Patent: Jun. 30, 1992

[54] CORONA WIRE TAPE ASSEMBLY

[75] Inventor: Conrad Altmann, Rochester, N.Y.

[73] Assignee: Eastman Kodak Company, Rochester, N.Y.

[21] Appl. No.: 669,713

[22] Filed: Mar. 15, 1991

[51] Int. Cl.[5] ..... G03G 15/02

[52] U.S. Cl. ..... 355/221; 250/324; 361/225

[58] Field of Search ..... 355/219, 221, 220, 223, 355/225, 226; 361/225, 230; 250/324, 325, 326; 174/117 F

[56] References Cited

U.S. PATENT DOCUMENTS

| | | | |
|---|---|---|---|
| 362,995 | 5/1887 | Pretty, Jr. | 174/117 F X |
| 753,461 | 3/1904 | Anderson | 174/117 FF X |
| 4,098,628 | 7/1978 | Walton | 174/117 F X |
| 4,513,170 | 4/1985 | Apodaca | 174/117 F X |

FOREIGN PATENT DOCUMENTS

| | | | |
|---|---|---|---|
| 54-11748 | 1/1979 | Japan | 250/325 |

*Primary Examiner*—A. T. Grimley
*Assistant Examiner*—Shuk Y. Lee
*Attorney, Agent, or Firm*—Lawrence P. Kessler

[57] ABSTRACT

A corona wire tape assembly for a corona charger apparatus, such wire tape assembly providing for a more durable corona wire which is kept substantially clean and which can readily be replaced. The corona wire tape assembly comprises at least one conductive wire adapted to generate ions when having a high voltage from an electrical potential source applied thereto. A flexible dielectric film, separable into lengths substantially corresponding to desired corona wire lengths, encases the conductive wire. The flexible dielectric film defines a first series of openings communicating with the conductive wire to expose the wire to facilitate ion generation and a second series of openings communicating with the conductive wire to facilitate electrical connection of the wire to an electrical potential source.

12 Claims, 2 Drawing Sheets

CORONA WIRE TAPE ASSEMBLY

BACKGROUND OF THE INVENTION

This invention relates generally to corona charger apparatus, and more particularly to corona wire in the form of a tape assembly for corona charger apparatus.

In many types of printing apparatus, such as for example electrostatographic reproduction devices, it is common practice to use corona charger apparatus to provide an electrostatic field for various purposes such as uniformly charging a dielectric support or transferring a marking particle developed image from the dielectric support. Typical corona charger apparatus include a thin wire, fabricated of tungsten for example, to which a high voltage is applied to generate ions or charge current to charge a surface (dielectric support or receiver member) located closely adjacent to the charger apparatus. If desired, an electrically biased grid may be interposed between the wire and the surface to control the charge deposited on the surface. The corona wire is tightly suspended between two insulating blocks which also provide a support for a connection to a high voltage source. Tension in the corona wire must be accurately set in order to prevent undesirable sagging of the wire if the tension is insufficient or breakage of the wire if the tension is too high. Since the corona wire is thin, it is fragile and setting and maintaining proper tension is difficult.

Further, while corona charger apparatus are noted for their ability to produce a relatively uniform charge deposit on a surface, the wire of the charger apparatus deteriorates over time. Such deterioration results in non-uniformity of the charge deposit with, for example, a corresponding degradation of the information reproduced by an electrostatographic reproduction device employing such corona charger. Accordingly, the corona charger apparatus wire must be periodically replaced to maintain high quality reproductions.

SUMMARY OF THE INVENTION

This invention is directed to a corona wire tape assembly for a corona charger apparatus, such wire tape assembly providing for a more durable corona wire which is kept substantially clean and which can readily be replaced. The corona wire tape assembly comprises at least one conductive wire adapted to generate ions when having a high voltage from an electrical potential source applied thereto. A flexible dielectric film, separable into lengths substantially corresponding to desired corona wire lengths, encases the conductive wire. The flexible dielectric film defines a first series of openings communicating with the conductive wire to expose the wire to facilitate ion generation and a second series of openings communicating with the conductive wire to facilitate electrical connection of the wire to an electrical potential source.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENTS

Figure 1A:
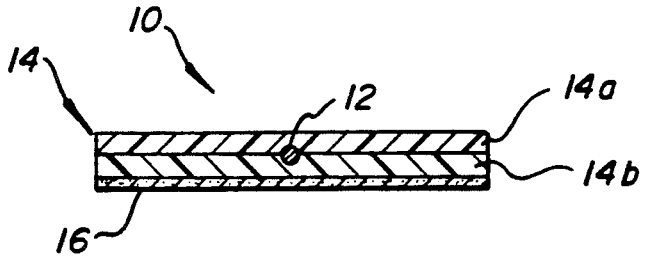
FIGS. 1*a*–1*c* are end elevational views, in cross-section, of respective embodiments of the corona charger apparatus wire tape assembly according to this invention.
Figure 1B:
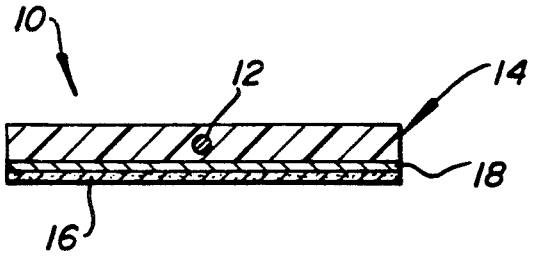
Figure 1C:
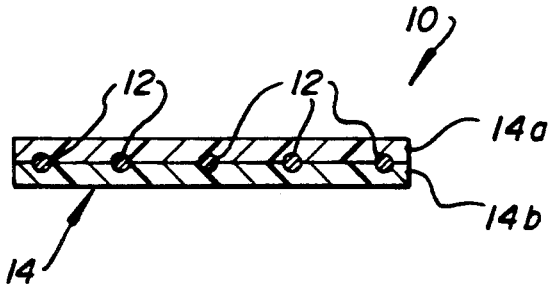

Referring now to the accompanying drawings, FIGS. 1*a*–1*c* show the wire tape assembly, designated generally by the numeral 10, according to this invention. The wire tape assembly 10 comprises at least one thin conductive wire 12 (plurality of substantially parallel wire shown in the embodiment of FIG. 1*c*) encased in an elongate flexible dielectric film 14. The wire 12 may be made of any conventional conductive filament material such as stainless steel, gold, aluminum, copper, tungsten, or platinum for example. The film 14 may be made of any conventional flexible dielectric material such as polyethylene terephthalate for example.

Construction of the wire tape assembly 10 may be alternatively accomplished as follows. In the embodiment shown in FIGS. 1*a* and 1*c*, two layers of film 14*a*, 14*b* are formed in intimate contact with the conductive wire(s) 12 sandwiched therebetween; in the embodiment shown in FIG. 1*b*, the conductive wire 12 is imbedded in a single layer of cast film 14. With either method for forming the wire tape assembly 10, a layer 16 of any suitable adhesive coating may be applied to one surface of the dielectric film 14. The adhesive coating layer 16 enables the wire tape assembly to be mounted to a suitable substrate as will be described below with reference to FIG. 5. Further, if the corona apparatus which will employ the wire tape assembly according to this invention requires a ground plane, a suitable conductive metallic film 18 can be formed, as the ground plane, in association with a surface of the dielectric film 14 (see FIG. 1*b*).

Figure 2:
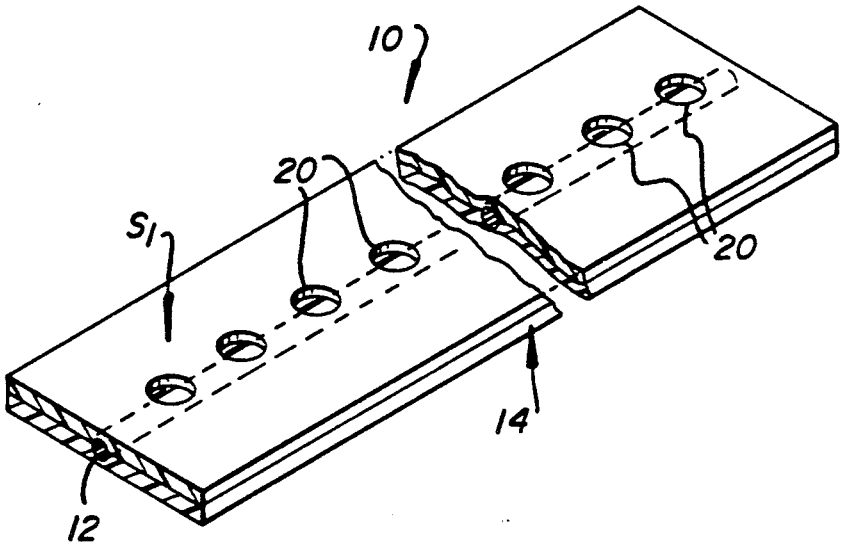
FIG. 2 is a top view, in perspective, of the corona charger apparatus wire tape assembly according to this invention in its unrolled form, showing the small perforations therein.
Figure 3:
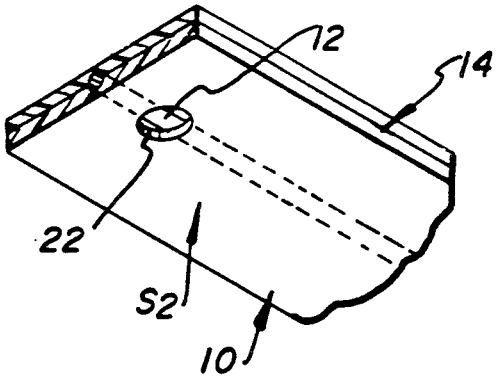
FIG. 3 is a bottom view, in perspective, of the corona charger apparatus wire tape assembly according to this invention in its unrolled form, showing enlarged perforations therein for connection to a source of electrical potential.

A first surface $S_1$ of the dielectric film 14 has a series of relatively small, closely spaced perforations 20 formed therein (see FIG. 2). The perforations 20, which may be formed as an integral part of the film or drilled therein at some subsequent time, are located to communicate with the conductive wire(s) 12. The wire is thus exposed to the atmosphere so that upon application of a high voltage potential to the wire generation of air ions is facilitated. The surface $S_2$ of the dielectric film 14 (opposite to the surface $S_1$) has a series of relatively large perforations 22 formed therein (one shown in FIG. 3). The perforations 22, which may be formed as an integral part of the film or drilled therein at some subsequent time, are located to communicate with the conductive wire(s) 12 at a spacing therealong substantially equal to the desired length of the corona wire for a selected corona charger apparatus. The wire 12 is exposed by the perforations 22 so that electrical contact with a high voltage potential source can readily be effected.

Figure 4:
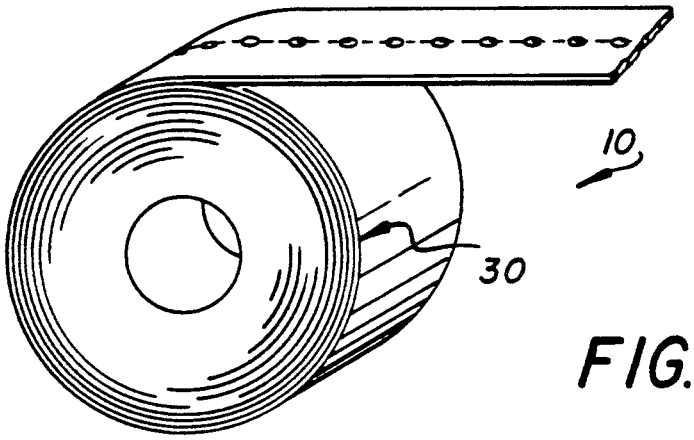
FIG. 4 is a view, in perspective, of the corona charger apparatus wire tape assembly according to this invention in its rolled form for storage.

With the wire tape assembly 10 according to this invention constructed in the above described manner, the wire tape can be formed into a roll 30 as shown in FIG. 4. In this rolled form, the wire tape assembly is easily carried or stored and provides maximum protection prior to use. Further, a desire length of the wire tape assembly 10 can be easily unrolled and separated from the roll 30 for use in a corona charger to initially provide the corona wire or replace corona wire tape assembly as required.

Figure 5:
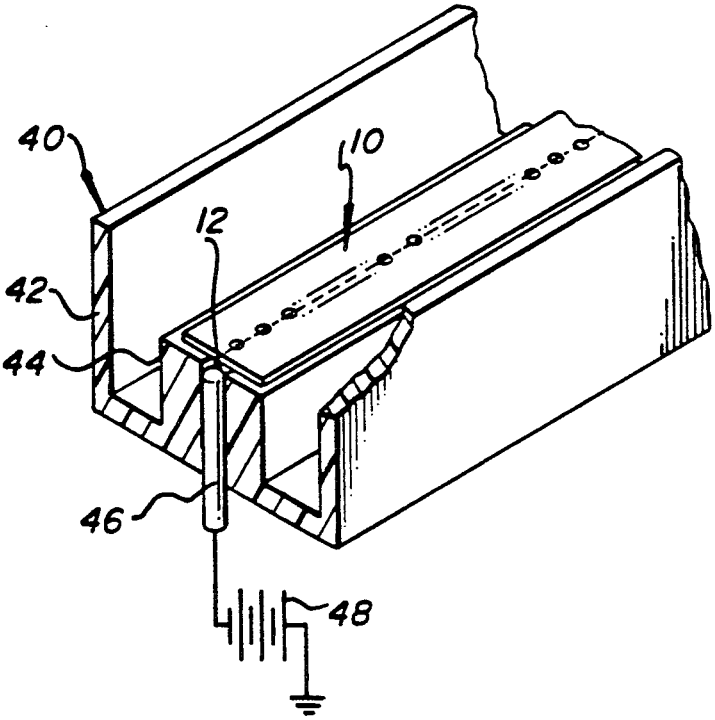
FIG. 5 is a cross-sectional view, in perspective, of a corona charger apparatus employing the wire tape assembly according to this invention, with portions broken away or removed to facilitate viewing.

The use of the wire tape assembly 10 constructed according to this invention in a corona charger is shown in FIG. 5. The exemplary corona charger, designated by the numeral 40, includes a body 42 having a portion 44 adapted to serve as a corona wire supporting substrate. An appropriately selected length of the wire tape assembly 10 is fixed to the substrate, such as by adhesive attachment through the previously described adhesive layer 16. The substrate portion 44 of the corona charger 40 is particularly configured such that the wire 12 of the assembly 10, conforming to the substrate portion, is accurately located relative to the corona charger body 42 and thus the apparatus (not shown) with which the corona charger is to be associated. An electrical contact post 46 is supported in the body 42 and extends through the portion 44 to engage the wire 12 through the communication perforation 22. The post 46 can then be coupled to a high voltage potential source 48 to enable high voltage to be applied to the wire 12 during desired operation of the corona charger.

As can readily be appreciated, the use of the wire tape assembly 10 according to this invention in a corona charger 40 provides unique advantages over conventional corona charger wires. The wire 12 of the wire tape assembly 10 is substantially protected from contamination, and is thus less likely to cause charger induced defects due to contamination. Also, there is no requirement that the wire 12 be maintained under a particularly tension to remain in proper relation to the charger body or the apparatus with which the corona charger is associated. The supporting substrate portion 44 of the corona charger can be designed to locate the wire at a particularly desired relation to the corona charger and thus the apparatus with which the corona charger is associated. Since the wire 12 is protected by the flexible dielectric film 14 and not kept under tension, the wire itself can be of a smaller diameter and be formed from weaker materials than heretofore utilized. Such attributes of the wire have been found to be desirable in that smaller diameter wires generate stronger electrical fields and certain weaker material (such as gold for example) are more corrosion resistant.

The invention has been described in detail with particular reference to preferred embodiments thereof, but it will be understood that variations and modifications can be effected within the spirit and scope of the invention.

I claim:

1. For use with a corona charger apparatus, a corona wire tape assembly for forming the corona wire for said charger apparatus, said tape assembly comprising:

at least one conductive wire adapted to generate ions when having a high voltage from an electrical potential source applied thereto; and a flexible dielectric film separable into lengths substantially corresponding to desired corona wire lengths, said flexible dielectric film encasing said at least one conductive wire and defining a first series of openings communicating with said at least one wire to expose said wire to facilitate ion generation, and further defining a second series of openings communicating with said at least one wire to facilitate electrical connection of said at least one wire to an electrical potential source.

2. The invention of claim 1 wherein said flexible dielectric film is of cast construction having said at least one conductive wire imbedded therein.

3. The invention of claim 1 wherein said flexible dielectric film is constructed as a pair of dielectric films having said at least one conductive wire sandwiched therebetween.

4. The invention of claim 1 wherein said flexible dielectric film includes means for affixing said corona wire tape assembly to a substrate.

5. The invention of claim 1 wherein said affixing means includes an adhesive layer coating.

6. The invention of claim 1 wherein said flexible dielectric film includes a flexible metallic layer to provide a ground plane.

7. The invention of claim 1 wherein said flexible dielectric film is in the form of an elongated flat tape.

8. The invention of claim 1 wherein said first series of openings are perforations respectively formed in one surface of said tape.

9. The invention of claim 1 wherein said second series of openings are perforations respectively formed in one surface of said tape.

10. The invention of claim 1 wherein said first series of openings are perforations respectively formed in one surface of said tape, and said second series of openings are perforations respectively formed in the opposite surface of said flat tape.

11. The invention of claim 10 wherein said perforations of said first series of openings are relatively closely spaced, and said perforations of said second series of openings are relatively spaced at substantially greater intervals than said first mentioned perforations.

12. The invention of claim 1 including a plurality of conductive wires.

* * * * *